United States Patent [19]

Sloan

[11] 4,214,290

[45] Jul. 22, 1980

[54] CONTROL CIRCUIT FOR ELECTROMAGNETICALLY OPERATED CONTACTOR

[75] Inventor: Albert E. Sloan, Gateshead, England

[73] Assignee: Sevcon Limited, Gateshead, England

[21] Appl. No.: 778,857

[22] Filed: Mar. 18, 1977

[30] Foreign Application Priority Data

Mar. 19, 1976 [GB] United Kingdom ..... 11219/76

[51] Int. Cl.[2] ..... H01F 7/18

[52] U.S. Cl. ..... 361/154; 361/187

[58] Field of Search ..... 318/139, 440, 331, 341; 361/196, 203, 159, 152, 154, 155, 160, 156, 187; 323/22 T

[56] References Cited

U.S. PATENT DOCUMENTS

| | | | |
|---|---|---|---|
| 3,237,088 | 2/1966 | Karp et al. | 323/22 T |
| 3,549,955 | 12/1970 | Paine | 361/155 |
| 3,737,736 | 6/1973 | Stampfli | 361/154 |
| 3,786,314 | 1/1974 | Misch | 361/154 |
| 3,878,446 | 4/1975 | Brandt | 318/442 |
| 3,944,900 | 3/1976 | Rohsler | 318/139 |
| 4,016,459 | 4/1977 | Boehringer | 323/22 T |
| 4,041,546 | 8/1977 | Stewart | 361/152 |
| 4,048,665 | 9/1977 | Lia et al. | 361/152 |

*Primary Examiner*—David Smith, Jr.
*Attorney, Agent, or Firm*—Alfred H. Rosen

[57] ABSTRACT

A control circuit for controlling the current supplied from a d.c. source such as a battery to the actuating coil of an electromagnetically operated contactor, comprising switching means such as a transistor operable repetitively to connect the coil to and disconnect the coil from the source, and control circuit means for varying the mark-to-space ratio of the switching thereby to vary the mean voltage applied to the coil. The mean voltage can be controlled so that the mean current through the coil when the contactor is closed remains substantially constant irrespective of the voltage of the battery, so that the same contactor and control circuit can be used with a number of batteries of different voltages.

6 Claims, 4 Drawing Figures

Figure 1:
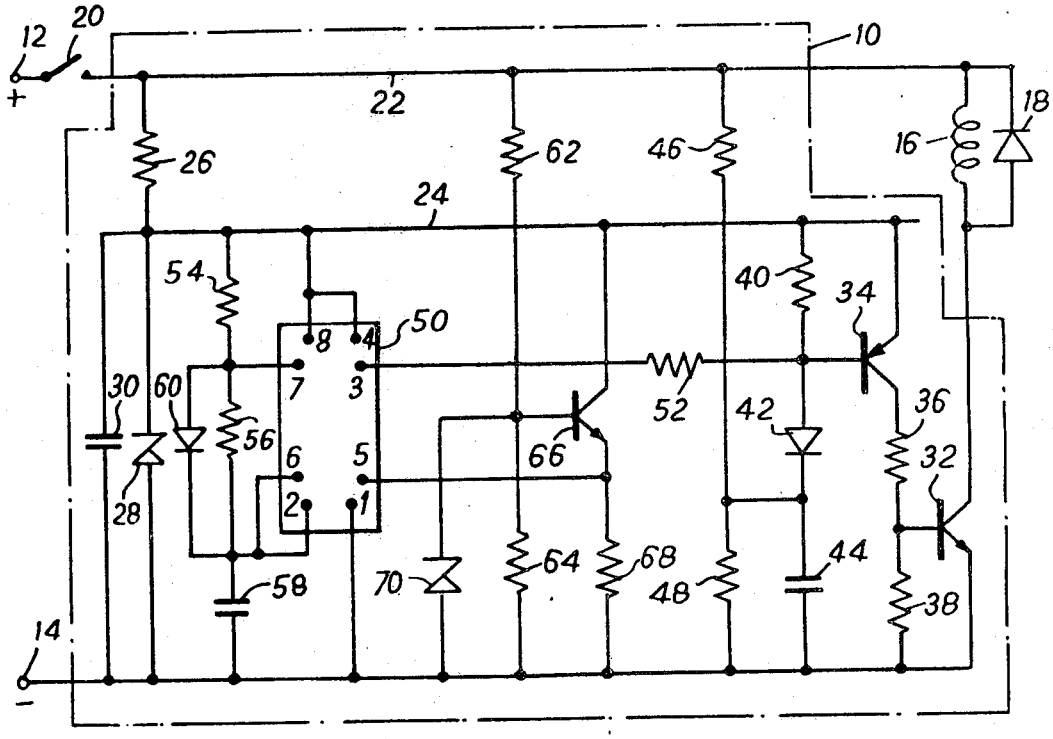

80
78
$V_C$ VOLTS
40
35
30
25
23
20
35
45
55
65
75
85
95
105
$V_B$ VOLTS

CONTROL CIRCUIT FOR ELECTROMAGNETICALLY OPERATED CONTACTOR

This invention relates to electromagnetically operated contactors.

The invention relates particularly, but not exclusively, to contactors for use with pulse control equipment for d.c. loads, e.g. the "forward" and "reverse" contactors of a d.c. motor which are actuated to connect the armature or field of the motor to the source in the appropriate direction to effect "forward" or "reverse" drive of the motor.

Such equipment is often required for use with a variety of different voltage supplies. A problem therefore arises in matching each contactor in the equipment with the supply voltage, to ensure that the appropriate voltage is applied to the contactor actuating coil. Hitherto this has been achieved in one of three ways, by providing a different, appropriately rated, set of contactors for each different supply voltage, by providing dropping resistors in series with the contactor coils to reduce the voltage applied to the coils, or by supplying the contactors from a stabilised voltage supply derived from the battery. The latter method involves providing a standard stabilised supply unit, which is difficult because of the variation in supply voltage with which the unit has to deal. These known solutions involve the use of additional semiconductors or switches to allow the selective operation of individual contactors in the equipment, with a consequent increase in expense.

Moreover, it is often necessary to provide means for automatically opening the contactors in response to a signal from fault-detecting circuitry in the equipment, e.g. in a thyristor pulse controller, a signal from a "fail-safe" circuit indicating that the main thyristor has remained in conduction for an excessive length of time. Hitherto, the contactor coils have usually been connected in series with thyristors to allow the coils to be selectively energised and to enable them to be de-energised in response to a fault condition.

It is an object of this invention to provide improved circuitry for controlling the actuation of electromagnetically operated contactors.

According to this invention there is provided a circuit for controlling the current supplied from a d.c. source to the actuating coil of an electromagnetically operated contactor, comprising semiconductor switching means for connection between the d.c. source and the coil and operable repetitively to connect the coil to and disconnect the coil from the d.c. source thereby to vary the mean voltage applied to the coil, and control circuit means for varying the mark-to-space ratio of switching of the semiconductor switching means.

The invention enables the mean voltage applied to the contactor coil to be adjusted to an optimum level, by adjusting the mark-to-space ratio of switching of the semiconductor switching means, irrespective of the supply voltage, so that a single contactor and control circuit can be supplied for use with a wide range of supply voltages.

Preferably, the circuit includes sensing means for sensing the voltage of the d.c. source or the mean current in the coil, and the control circuit means is operable to vary the mark-to-space ratio of switching of the semiconductor switching means in response to the magnitude of the voltage or current sensed by the sensing means, thereby to vary the mean voltage applied to the coil so that, in use, the mean current in the coil when the contactor is closed is held at a predetermined level equal to or higher than the holding current of the coil.

Advantageously, the control circuit means includes current shaping means adapted, on actuation of the contactor, to allow the mean current through the coil to rise to a level above that required to cause closure of the contacts of the contactor and, after a time long enough to ensure closure of the contacts, to reduce the mean coil current and hold it at a predetermined level equal to or higher than the holding level of the contactor.

Since the operating current for a contactor, i.e. the current required to cause the contacts to close, is considerably greater than the holding current required to hold the contacts closed, this enables the current in the coil to be held for a large proportion of the time at a level considerably less than is necessary with contactor systems known hitherto. Thus coils of a lower nominal rating can be used.

The shaping circuit can be designed to provide the optimum variation of contactor current with time on actuation of the contactor. It may, for example, be possible to shape the operating current in such a way as to reduce the occurrence of contactor bounce, which is normally associated with the high kinetic energy of the contactor armature when it comes into contact with the yoke, the kinetic energy being dependent on the energy supplied to the contactor coil during closing of the contactor.

The semiconductor switching means preferably comprises a transistor. Since, with use of current shaping means as defined above, the transistor normally has to carry only the relatively low holding current of the contactor, the transistor can be relatively small, and consequently inexpensive.

The circuit of this invention also provides a means for releasing the contactor in response to a signal from fault-detecting circuitry, the transistor or other semiconductor switching means being rendered non-conducting to de-energise the contactor coil. In circuits employing current-shaping circuitry as defined above, the release of the contactor in response to a fault signal will be quicker than in known circuits, since the coil current has to decay only from a level just above the holding current level.

The components of the circuit of this invention can be constructed as a standard module for connection in series with the contactor coil. Thus an individual module can be connected in series with the coil of each contactor in the equipment.

Figure 2:
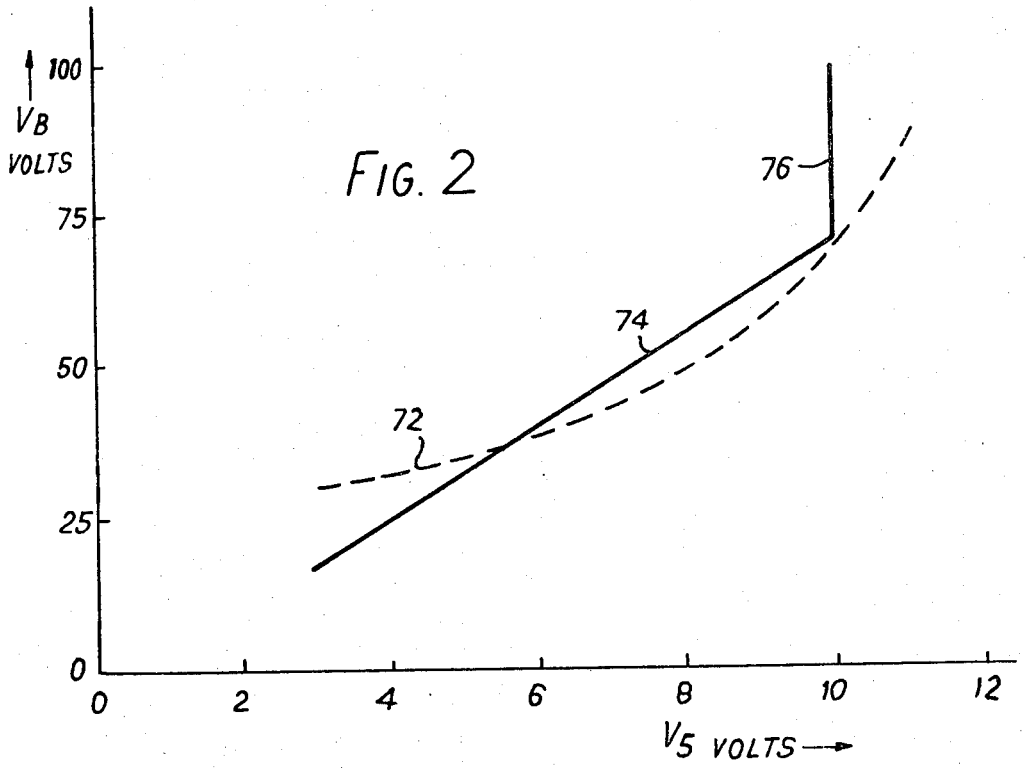
Figure 3:
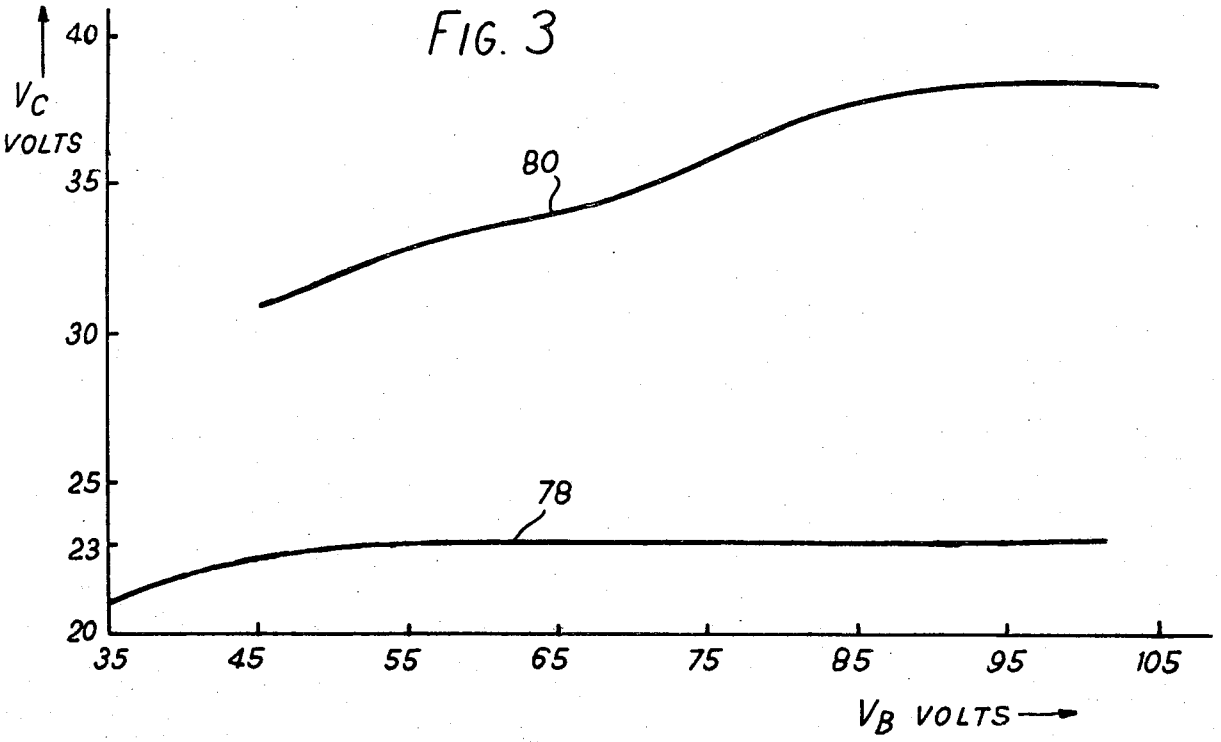
Figure 4:
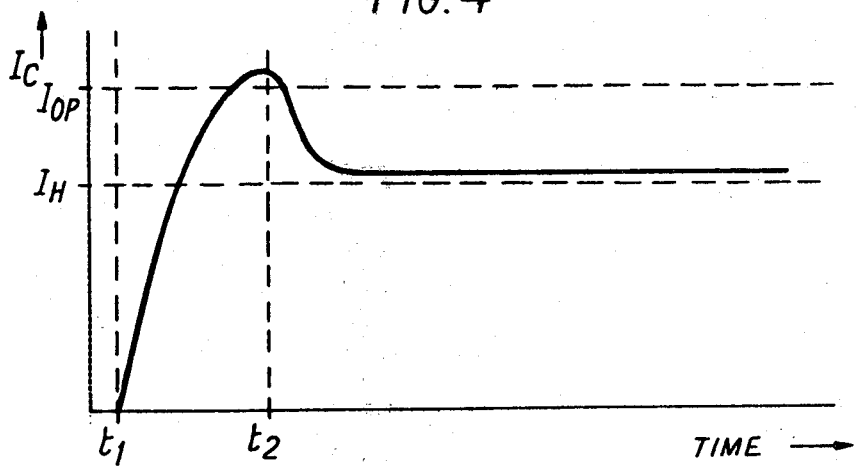

The invention will now be described, by way of example, with reference to the accompanying drawings, in which:

FIG. 1 is a circuit diagram of a control module in accordance with the invention, in circuit with the actuating coil of a contactor, FIG. 2 is a graph showing voltage characteristics of part of the circuit of FIG. 1, FIG. 3 is a graph showing the variation of voltage applied to the contactor coil in the circuit of FIG. 1 with varying battery voltage, FIG. 4 is a graph showing the general form of the variation with time of current flowing in the contactor coil in the circuit of FIG. 1.

Referring to the drawings, FIG. 1 shows a contactor control module 10 connected to positive and negative terminals 12 and 14 of a battery and in circuit with actuating coil 16 of a contactor. A freewheel diode 18 is connected across the contactor coil 16 to provide a path for current in the coil during interpulse periods in operation as described below. The operating switch 20 of the contactor is connected between the positive terminal 12 and the positive rail 22 of the module.

The module includes a 12 volt stabilised voltage rail 24, supplied by a voltage stabilising circuit consisting of a resistor 26 and zener diode 28 connected between the positive rail 22 and the negative terminal 14, and a capacitor 30 connected across the zener diode 28.

Current is supplied to the contactor coil 16 through an n-p-n transistor 32, the emitter of which is connected to the negative terminal 14 and the collector of which is connected to one side of the contactor coil 16, the other side of the coil being connected to the positive rail 22. Base drive to transistor 32 is supplied through a p-n-p transistor 34, the emitter of which is connected to the 12 volt rail 24 and the collector of which is connected to the negative terminal 14 through two series-connected resistors 36 and 38. The junction of the two resistors 36 and 38 is connected to the base of transistor 32, so that transistor 32 is switched into conduction whenever transistor 34 is conducting.

The base of transistor 34 is connected to the 12 volt rail 24, through a resistor 40, and to the anode of a diode 42, the cathode of which is connected to the negative terminal 14 through a capacitor 44. The cathode of diode 42 is also connected to the junction of two resistors 46 and 48 connected as a voltage divider between the positive rail 22 and the negative terminal 14.

A second base drive for p-n-p transistor 34 is supplied by a square wave oscillator 50, pin 3 of which is connected through a resistor 52 to the base of transistor 34. The oscillator 50 produces at pin 3 a square wave output, the fundamental frequency of which is determined by the RC circuit consisting of resistors 54 and 56 connected in series with capacitor 58 between the 12 volt rail 24 and the negative terminal 14, and diode 60 connected across resistor 56. The mark-space ratio of the square wave is modified in dependence on the voltage applied to pin 5 of the oscillator 50, the duration of each period in which the output is positive-going increasing with increasing voltage applied to pin 5, whilst the duration of each period in which the output is negative-going remains constant (at a value set by the RC circuit).

A voltage proportional to the battery voltage is applied to pin 5 of oscillator 50 by means of a voltage divider consisting of resistors 62 and 64 connected in series between the positive rail 22 and the negative terminal 14. The junction of resistors 62 and 64 is connected to the base of an n-p-n transistor 66, the collector of which is connected to the 12 volt rail 24 and the emitter of which is connected to pin 5 of oscillator 50 and, through a resistor 68, to the negative terminal 14. Transistor 66 acts as an emitter follower to provide an interface between the resistors 62 and 64, which are of relatively high resistance to reduce power dissipation in the circuit, and the low impedance presented by the input to pin 5. To provide an upper limit to the voltage applied to pin 5, a zener diode 70 is connected between the base of transistor 66 and the negative terminal 14.

In operation of the circuit of FIG. 1, on closure of switch 20, the potential of rail 22 rises to battery voltage and that of rail 24 to 12 volts. The base of transistor 34 is initially connected to the potential of the negative terminal 14, through diode 42 and capacitor 44, so that the transistor is rendered conducting. Base drive is thus supplied to transistor 32, rendering that transistor fully conducting, so that full battery voltage is applied to the contactor coil 16. Transistor 34 remains conducting until capacitor 44 has charged, through resistor 40 and diode 42 and through resistor 46, to a voltage equal to that set by the voltage divider consisting of resistors 46 and 48, which, for a battery of voltage higher than, say, 20 volts, is set to be greater than 12 volts. The diode 42 is therefore reverse biased, thereby removing the base drive to transistor 34 via diode 42. Thereafter, base drive to transistor 34 is supplied from oscillator 50 through resistor 52, so that the transistor is rendered conducting during negative-going portions of the square wave form and non-conducting during positive-going portions of the wave form. Transistor 32 is thus similarly rendered alternately conducting and non-conducting, so that battery voltage is applied to the coil 16 in a series of pulses, the mean voltage applied to the coil being thus reduced to a value dependent on the mark-space ratio of the pulses. During the interpulse periods, when transistor 32 is non-conducting, the current flowing in coil 16 circulates through the freewheel diode 18.

The circuit components are selected so that the time taken for capacitor 44 to charge to the voltage set by resistors 46 and 48 is sufficient to ensure that the current in coil 16 rises to a level above the actuating current, to ensure that the contactor closes. The mark-space ratio of voltage applied subsequently to the coil is such as to maintain the current through the coil at a level just above the holding current for the contactor. Since the mark-space ratio is dependent on the voltage applied to pin 5 of oscillator 50 by the voltage divider 62, 64, and therefore on the battery voltage, the mark-space ratio will automatically adjust itself to the battery voltage, so that the mean voltage applied to the contactor coil 16 will be at a substantially constant predetermined level irrespective of the nominal voltage of the battery with which the contactor is used and of changes in the actual battery voltage during use.

In practice, to avoid undue complexity of the circuitry, it may be desirable to accept some departure from true constancy of the mean voltage applied to the coil. For example, with a circuit employing as oscillator 50 an integrated circuit timer of the type designated NE555V manufactured by National Semiconductors, the broken line 72 in FIG. 2 shows the ideal curve of variation of the voltage $V_5$ applied to pin 5 with change in battery voltage $V_B$ to give a constant mean voltage across the capacitor coil. The solid line 74 shows the actual linear variation produced by the circuit of FIG. 1 (line 76 showing the limiting voltage set by zener diode 70), and it is found that this approaches closely enough to the ideal curve. FIG. 3 shows the results of tests carried out with the circuit of FIG. 1, line 78 and 80 indicating the variation in the mean voltage $V_C$ across the coil 16 with change in battery voltage $V_B$, for 24 volt and 36 volt contactors respectively. The difference in the mean voltage required for each contactor is effected by altering the values of resistors 54 and 56 to change the fundamental frequency of the oscillator 50. It should be noted that, although line 78 shows that in the tests the mean coil voltage $V_C$ was set at 23 volts, it would in practice be set as a lower level, say 18 or 20 volts, sufficient to maintain the holding current level of a 24 volt contactor.

FIG. 4 shows the general shape of the variation with time of the current $I_C$ in coil 16 on closure of switch 20, the current rising initially above the operating current level $I_{OP}$ and then falling to a constant level somewhat higher than the holding current level $I_H$. The times $t_1$ and $t_2$ indicate the times of closure of switch 20 and of closure of the contactor contacts.

It will be appreciated that if the circuit of FIG. 1 is used with a battery of voltage lower than, say 20 volts, so that the voltage at the junction of resistors 46 and 48 is less than 12 volts, the base drive to transistor 34 via diode 42 will be permanently applied, so that transistors 34 and 32 will be held fully conducting whenever switch 20 is closed, to apply full battery voltage to coil 16.

It will be apparent that many modifications could be made in the described embodiments. For example, various alternative methods could be used to sense the battery voltage or the current in coil 16, e.g. by sensing the voltage developed across the freewheel diode 18 during interpulse periods.

I claim:

1. In combination with an electromagnetically operated contactor having an actuating coil connected to a d.c. source, a circuit for controlling the mean current supplied from the d.c. source to the actuating coil, the circuit comprising semiconductor switching means connected between the d.c. source and the coil and operable repetitively to connect the coil to and disconnect the coil from the d.c. source thereby to vary the mean voltage applied to the coil, and control circuit means for varying the mark-to-space ratio of switching of the semiconductor switching means, the control circuit means comprising voltage sensing means connected to the d.c. source for sensing the voltage of the d.c. source and means for varying the mark-to-space ratio of switching of the semiconductor switching means in dependence only on the magnitude of the sensed voltage, said means reducing said mark-to-space ratio on increase of said sensed voltage, whereby the mean voltage applied to the coil is maintained substantially constant so that the mean current in the coil on energization of the contactor is held at a predetermined level at least equal to the holding current of the coil substantially independent of the magnitude of the source voltage over a range of d.c. source voltages.

2. A circuit as claimed in claim 1, in which the switching means are adapted, on actuation of the contactor, to connect the coil continuously to the d.c. source for a time sufficient to allow the mean current through the coil to rise to a level above that required to cause closure of the contacts of the contactor, and thereafter to cause repetitive connection and disconnection of the coil from the source to reduce the mean current to said predetermined level.

3. A circuit as claimed in claim 1, in which the semiconductor switching means comprises a transistor.

4. A circuit as claimed in claim 3, in which the control circuit means includes a square wave oscillator arranged to supply a square wave form voltage to the base emitter path of the transistor thereby to render the transistor alternately conducting and non-conducting.

5. A circuit as claimed in claim 4, in which there are provided circuit means operable, on initial actuation of the contactor, to provide base drive to the transistor to render the transistor fully conducting for a time sufficient to allow the current in the coil to rise to a level above that required to cause closure of the contacts of the contactor.

6. A circuit as claimed in claim 1, in which the semiconductor switching means and control circuit means are housed in a module adapted for connection in series with a d.c. source and the actuating coil of a contactor.

* * * * *